United States Patent [19]

Maruyama et al.

[11] 4,395,208

[45] Jul. 26, 1983

[54] ROTARY VANE COMPRESSOR WITH WEDGE-LIKE CLEARANCE BETWEEN ROTOR AND CYLINDER

[75] Inventors: Teruo Maruyama, Neyagawa; Tatsuhisa Taguchi, Shiga; Tadayuki Onoda, Toyonaka, all of Japan

[73] Assignee: Matsushita Electric Industrial Co., Ltd., Kadoma, Japan

[21] Appl. No.: 251,943

[22] Filed: Apr. 7, 1981

[30] Foreign Application Priority Data

Apr. 7, 1980 [JP] Japan ..... 55-45350

[51] Int. Cl.[3] ..... F04C 18/00; F04C 27/00; F04C 29/02

[52] U.S. Cl. ..... 418/102; 418/150; 418/259

[58] Field of Search ..... 418/102, 150, 189, 259, 418/270

[56] References Cited

U.S. PATENT DOCUMENTS

| | | | |
|---|---|---|---|
| 793,664 | 7/1905 | Kleindienst | 418/259 |
| 3,877,127 | 4/1975 | Takahashi et al. | 418/150 |
| 3,890,071 | 6/1975 | O'Brien | 418/150 |

FOREIGN PATENT DOCUMENTS

| | | | |
|---|---|---|---|
| 1428059 | 5/1969 | Fed. Rep. of Germany | 418/270 |

*Primary Examiner*—John J. Vrablik

*Attorney, Agent, or Firm*—Wenderoth, Lind & Ponack

[57] ABSTRACT

An improved rotary compressor of sliding vane type in which a rotor head portion is provided where the peripheral surface of the rotor approaches the inner peripheral surface of the cylinder so as to divide the interior of the cylinder into a discharge side and a suction side for fluid, while the cylinder is formed with a seal portion where a clearance between the rotor and cylinder at the rotor head portion is formed into a wedge-like configuration in a rotational direction by an arc having a radius of curvature smaller than a radius of the cylinder.

2 Claims, 8 Drawing Figures

ROTARY VANE COMPRESSOR WITH WEDGE-LIKE CLEARANCE BETWEEN ROTOR AND CYLINDER

The present invention generally relates to a compressor and more particularly to an improvement in a volume type rotary compressor mainly constituted by a cylinder, a rotor and vanes movably provided in the rotor, and end plates for closing opposite end portions of said cylinder so as to define a vane chamber therebetween.

Figure 1:
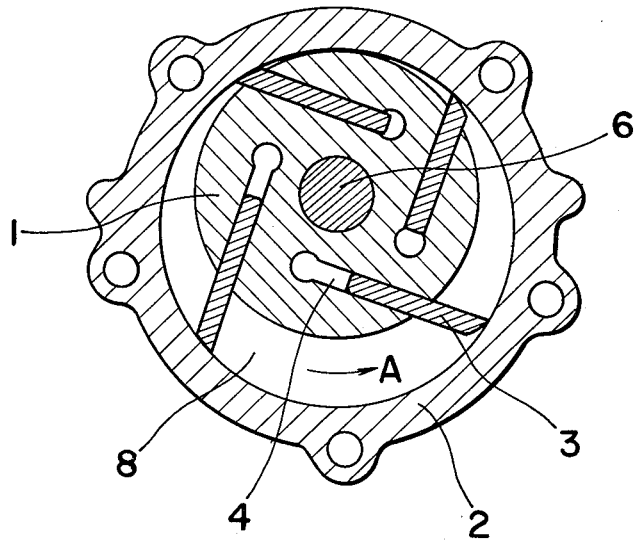
Fig. 1 PRIOR ART
Figure 2:
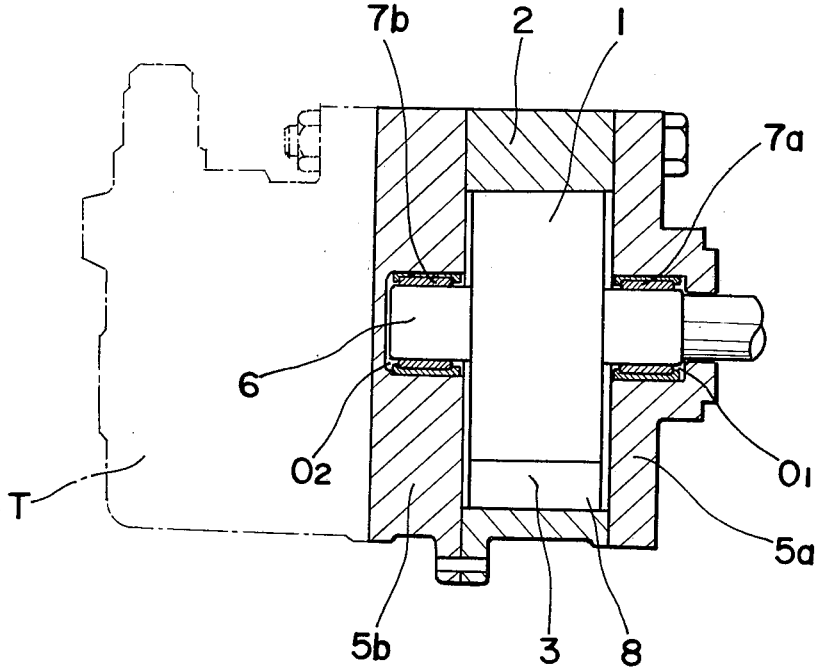
Fig. 2 PRIOR ART

As shown in FIGS. 1 and 2, a known sliding vane type rotary compressor generally includes a cylinder 2 having a cylindrical space therein constituting a vane chamber 8, end walls, i.e. front and rear plates 5*a* and 5*b* secured to opposite end faces of the cylinder 2 for closing the vane chamber 8, a rotor 1 eccentrically rotatably provided within the vane chamber 8 so as to rotate in the direction indicated by the arrow A, a plurality of vanes 3 each slidably received in corresponding sliding grooves or slits 4 formed in the rotor 1, a rotary shaft 6 fixed to the rotor 1 for simultaneous rotation therewith and rotatably supported by the front and rear plates 5*a* and 5*b* in front and rear needle bearings 7*a* and 7*b* accommodated in corresponding openings 01 and 02 respectively formed in said plates 5*a* and 5*b*, one end of the rotary shaft 6 further extending outwardly from the front plate 5*a* through a mechanical seal (not shown) or the like, and an oil tank T coupled to the vane chamber 8 at the end face of the rear plate 5*b* remote from the rotor 1.

In the above arrangement, during rotation of the rotor 1, the vanes 3 are urged outwardly from the outer periphery of the rotor 1 by centrifugal force, said vanes 3 sliding in the sliding grooves 4, while rotating together with the rotor 1, with the forward edges of the vanes 3 sliding against the inner surface of the cylinder 2 so as to prevent leakage of refrigerant such as Freon gas or the like being compressed.

In the conventional rotary type compressor as described above, however, there have been problems related to leakage of refrigerant within the compressor as follows.

Figure 3:
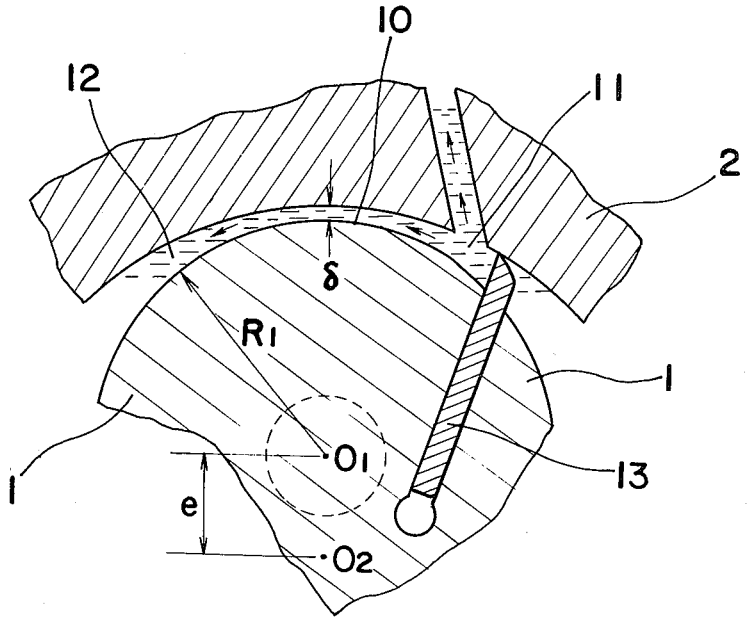
Fig. 3 PRIOR ART

More specifically, as shown in FIG. 3, in the conventional rotary compressor of the above described type, there is leakage of refrigerant, for example, Freon gas, at a head portion 10 of the rotor 1, from a vane chamber section 11 on the discharge side to a vane chamber section 12 on the suction side. Since the head portion 10 as described above is the spot where the pressure difference is the largest within the compressor, a large amount of the refrigerant tends to leak thereat, thus constituting a main factor reducing the volume efficiency of the compressor.

For minimizing the leakage as described above, it has been necessary to improve the dimensional accuracy of each part and also of the assembly so that the clearance $\delta$ between the head portion 10 of the rotor 1 and the inner surface of the cylinder 2 is reduced as much as possible.

The main locations where the improvement of the dimensional accuracy is required, are, for example, as itemized below.

(i) External diameter and roundness of the rotor 1.

(ii) Concentricity of the rotor 1 with respect to the rotary shaft 6.

(iii) Accuracy in the amount of eccentricity e between the center 02 of the cylinder 2 and the center 01 of the rotor 1 (FIG. 3).

Besides the accuracy required for each part and of the assembly, side play existing in the rolling members and race surfaces of the needle bearings 7*a* and 7*b*, thermal expansion of the respective parts due to temperature increases during high speed rotations, etc. result in deviation of the clearance $\delta$ at the head portion 10, thus constituting main factors in the leakage of refrigerant.

Thus, in the conventional compressors, it has been necessary to provide dimensional accuracy of parts sufficient for the clearance $\delta$ to be maintained at a minimum value on the plus side, and therefore, the leakage of refrigerant at the head portion 10 of the rotor 1 has presented a difficult problem heretofore thought to be substantially unavoidable.

For eliminating the problem related to the leakage of refrigerant as described above, there has also conventionally been proposed a method in which the configuration of the cross-section of the inner surface of the cylinder 2 confronting the head portion 10 of the rotor 1 is shaped in the form of an arc of a circle concentric with the rotor 1 and substended by an angle $\alpha$ with respect to the center 01 of the rotor 1 for increasing fluid resistance of refrigerant flowing from the discharge side vane chamber section 11 to the suction side vane chamber section 12. It is to be noted that in FIGS. 3 and 4, R1 represents the radius of the rotor 1 and R2 denotes the radius of the arc of the concentric circle to be formed in the inner surface of the cylinder 2.

In the known arrangement as described above, however, there still exist such problems that, even when the clearance $\delta$ between the inner surface of the cylinder 2 and the rotor 1 is precisely set so as to be as small as possible during assembly, a mechanical contact takes place therebetween during actual operation due to side play or looseness of the needle bearings 7*a* and 7*b*, errors in concentricity between the rotor 1 and the cylinder 2, etc., with consequent increase of losses due to such contact.

Accordingly, an essential object of the present invention is to provide an improved sliding vane type rotary compressor in which mechanical contact between the rotor and the cylinder is prevented so as to reduce the losses due to mechanical contact, and in which the clearance between the cylinder surface and rotor is minimized to prevent leakage of refrigerant thereby obtaining high efficiency of the compressor.

Another important object of the present invention is to provide an improved rotary compressor of the above described type which has a simple construction and which functions accurately, and can be readily manufactured on a large scale at low cost.

In accomplishing these and other objects, according to one preferred embodiment of the present invention, there is provided a sliding vane type compressor which includes a rotor, a plurality of vanes slidably received in corresponding sliding grooves in the rotor, a cylinder rotatably accommodating the rotor and vanes therein, end plates secured to opposite ends of the cylinder for defining a vane chamber between the cylinder, rotor and vanes, and a rotor head portion where the peripheral surface of the rotor approaches the inner peripheral surface of the cylinder so as to divide the interior of the cylinder into a discharge side and a suction side. The cylinder is provided with a seal portion where the clearance between the rotor and the cylinder at the rotor head portion has a wedge-like configuration in the rotational direction and defined by an arc having a radius of curvature smaller than the radius of the cylinder.

By the arrangement according to the present invention as described above, an improved rotary sliding vane type compressor, in which leakage of refrigerant is reduced, is advantageously provided, and in which there is simultaneous reduction of mechanical loss, thereby substantially eliminating disadvantages inherent in the conventional arrangements of this kind.

Figure 4:
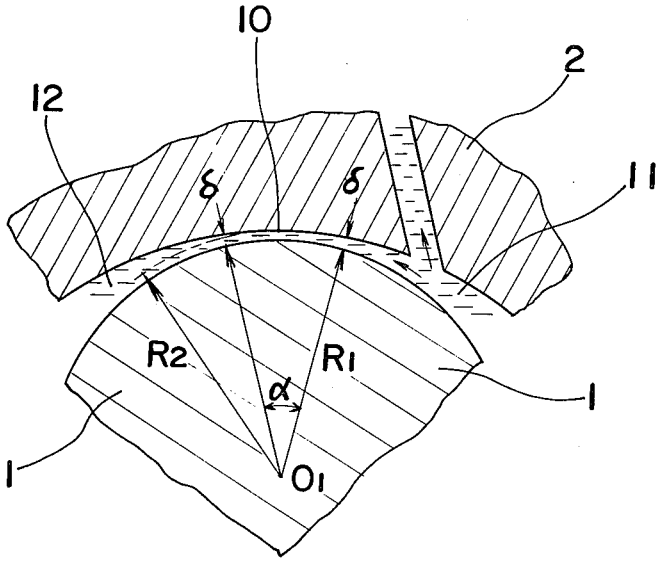
Fig. 4 PRIOR ART
Figure 5:
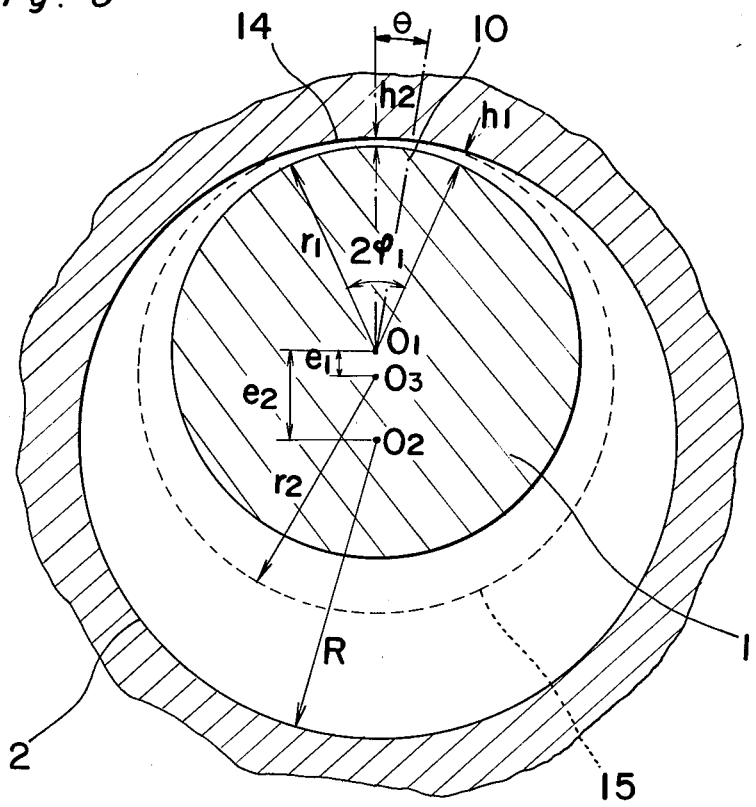
Figure 6:
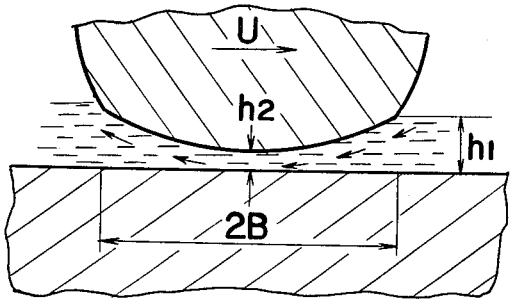
Figure 7:
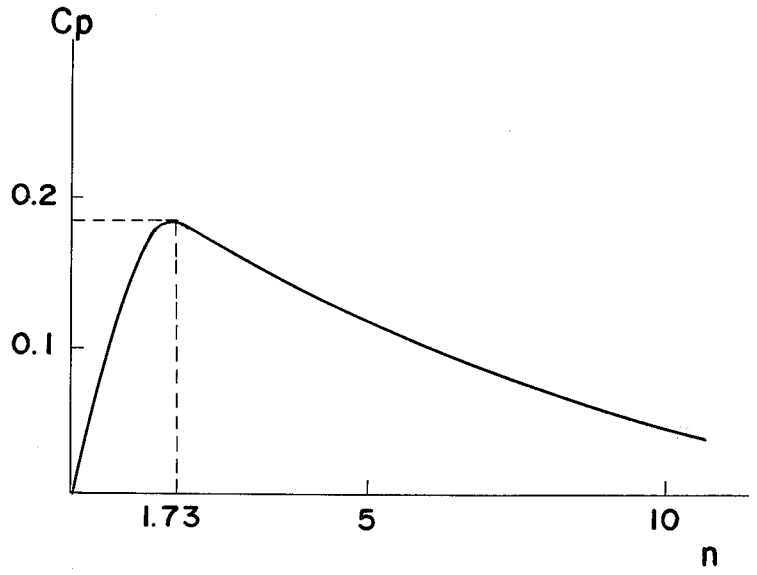
Figure 8:
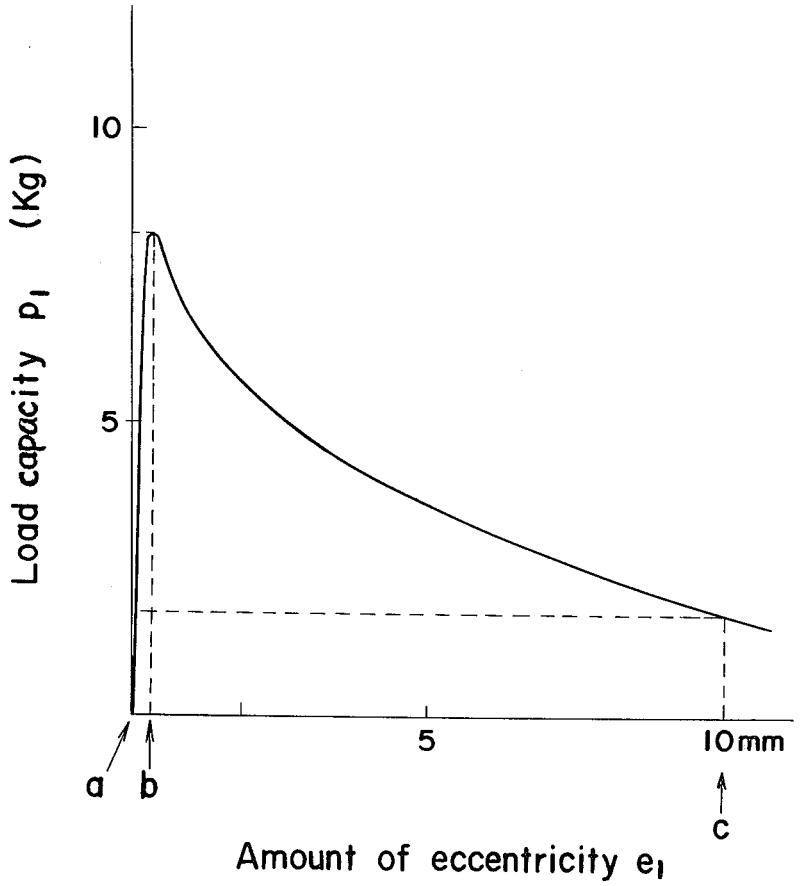

These and other objects and features of the present invention will become apparent from the following description of a preferred embodiment thereof taken with reference to the accompanying drawings, in which;

FIG. 1 is a schematic front sectional view of a conventional rotary sliding vane type compressor (already referred to), FIG. 2 is a schematic side elevational view, partly broken away and in section, of the compressor of FIG. 1, FIG. 3 is a fragmentary schematic sectional diagram showing, on an enlarged scale, one conventional arrangement between the inner surface of a cylinder and a rotor head portion (already referred to), FIG. 4 is a diagram similar to FIG. 3, which particularly shows another conventional arrangement therebetween (already referred to), FIGS. 5 and 6 are schematic sectional diagrams for explaining the principle of the arrangement between the inner surface of the cylinder and rotor head portion of a compressor according to one preferred embodiment of the present invention, FIG. 7 is a graph for explaining the variation of the load constant in the arrangement of FIG. 5, and FIG. 8 is a graph showing the relation between the load capacity and the amount of eccentricity (i.e. distance between the center of a seal circle of the cylinder and that of the rotor) in the arrangement of FIG. 5.

Before the description of the present invention proceeds, it is to be noted that like parts are designated by like reference numerals throughout the several views of the accompanying drawings.

In the first place, it is to be noted that, in the compressor according to the present invention, the inner surface of the cylinder has a seal portion 14 formed therein having a cross-sectional shape of an arc of a circle having a diameter larger than that of the rotor and having the center position between the center of a circle defining the cross-section of the rotor and the center of a circle defining the inner surface of the cylinder. The material of the cylinder is shaped, for example, by grinding or the like, so that a dynamic pressure bearing, in which the clearance between the cylinder inner surface and rotor surface forms a wedge-like oil film when viewed in section in the circumferential direction, is constituted thereat. By the above arrangement, mechanical contact between the rotor surface and the cylinder surface is prevented so as to bring about reduction of mechanical loss, and simultaneous prevention of leakage of the refrigerant is achieved.

It is also to be noted here that, except for the particular arrangements directly related to the present invention as described above, the construction of the compressor according to the present invention is generally the same that of the conventional compressor shown in FIGS. 1 and 2, and therefore, a detailed description thereof will be omitted for brevity in the description hereinbelow, with like parts being designated by like reference numerals in the drawings.

Referring now to the drawings, there is shown in FIG. 5 a schematic diagram showing the principle of the relation between the inner surface of the cylinder 2 and the rotor 1 of the compressor according to one preferred embodiment of the present invention, in which the dynamic pressure bearing effect is achieved by providing the wedge-like oil film produced by a seal portion 14 having a surface in the shape of an arc of a seal circle non-concentric with the rotor 1 at the seal portion of the cylinder 2 and opposite the rotor head portion 10, i.e. where the rotor is closest to the inner wall of the cylinder, as described earlier.

In FIG. 5, the center of the cross-section of the rotor 1 is designated by 01, the center of the cross-section of the inner peripheral wall of the cylinder 2 by 02, the center of the cross-section of the seal circle 15 of which the arc to be formed at the seal portion 14 of the cylinder 2 is a part is designated by 03, the distance between the centers 01 and 03 by e1, the distance between the centers 01 and 02 by e2, the radius of the rotor 1 by $r_1$ the radius of the seal circle 15 by $r_2$, the radius of the inner peripheral wall of the cylinder 2 by R, and the angle subtending the arc of the seal circle 15 forming the surface of seal portion to be formed in the inner peripheral wall of the cylinder 2 by $2\psi 1$ respectively.

On the assumption that c equals r2-r1, the clearance h between the surface of the rotor 1 and the surface of the seal portion 14 lying along the seal circle 15 may be represented by $$h \doteqdot c - e_1\cos(\psi_1 - \theta)$$
$$\doteqdot c - e_1 + \frac{e}{2}(\psi_1 - \theta)^2$$

and therefore, $$h = h_2\left[1 + n^2\frac{(B-x)^2}{B^2}\right] \quad (1)$$

where $x = r_1\theta$, $B = r_1\psi_1$, $h_2 = c - e_1$, and $$n = \sqrt{\frac{e_1}{2h_2}}\ \psi_1$$

and $\theta$ is the angle from the head portion 10.

Accordingly, the clearance h between the rotor 1 and the surface of seal portion 14 formed in the peripheral surface of the cylinder 2 and lying on seal circle 15, may be approximated to a space formed between a flat surface and a parabolic surface as shown in FIG. 6, in which h1 represents the clearance at the entrance portion (x=0) of the space, and h2 denotes the clearance at an apex portion (x=B) thereof. In the case where the clearance h is given an inclination as shown in FIG. 6, and is also filled with a lubrication oil, with the oil film relatively slipping in the form of a wedge, the pressure developed thereby may be represented by the following Reynolds equation, as is known to those skilled in the art.

$$\frac{d}{dx}\left(\frac{h^3}{\eta}\frac{dp}{dx}\right) = 6\mu U\frac{dh}{dx} \quad (2)$$

where $\eta$ is the viscosity of the lubrication oil, and U is the relative speed between the slipping surfaces.

Based on the above two equations (1) and (2), the total pressure produced at the head portion 10 of the rotor having an axial length L may be obtained by the following equation.

$$P_1 = \frac{\eta r_1 \omega B^2 L}{h_2^2} \cdot Cp \quad (3)$$

At the portion where the clearance h is divergent, i.e. where the relation $x > B$ exists, the pressure produced is theoretically in the relation $p < 0$, but in the actual practice, may be regarded as $p_1 \simeq 0$, since the negative pressure does not become so large as the positive pressure.

In connection with the above, in the interior of an ordinary rotary compressor, oil is circulated for the lubrication of the sliding portions, for example, between the vanes and rotor, and between the rotor and end plates, etc. However, since the refrigerant is dissolved in the oil, a flow of a mixture thereof with a low viscosity adheres to the rotor surface and inner peripheral wall of the cylinder for lubrication of the sliding portions.

In the graph of FIG. 7 showing the variation of values of the load constant Cp as the value n in the equation (1) is varied, it is noticed that the value Cp reaches a maximum value at $n = 1.73$.

Reference is made to the graph of FIG. 8 showing load produced as the value of e1, which is the distance (amount of eccentricity) between the center 03 of the seal circle 15 and the center 01 of the rotor 1, is varied, in the compressor according to one preferred embodiment of the present invention having the parameters as shown in Table 1 below.

TABLE 1

| Parameter | Symbol | Embodiment |
|---|---|---|
| Rotor diameter | $r_1$ | 32 mm$^R$ |
| Cylinder radius | R | 40 mm |
| Amount of eccentricity between rotor and cylinder | $e_2$ | 10 mm |
| Cylinder length | L | 36 mm |
| Top clearance | $h_2$ | 15$\mu$ |
| Seal portion angle | $\psi_1$ | 10° |
| Revolutions | $\omega$ | 1800 rpm |
| Oil viscosity | $\eta$ | 15 cst |

From FIG. 8, it is seen that the maximum load $P_1 = 8.2$ kg may be obtained when the amount of eccentricity $e_1$ equals 288$\mu$ (point b). In the case where the amount of eccentricity $e_1 = 0$ (point a), i.e. in the conventional arrangement wherein the concentric circle as shown in FIG. 4 is formed, no "wedge" pressure is produced, resulting in the relation $P_1 = 0$. On the other hand, in the case where the amount of eccentricity $e_1 = 10$ mm (point c), i.e. in the conventional arrangement as in FIG. 3 described earlier, the load capacity $P_1$ is small, i.e. around 1.7 kg, which is only about 1/5 of the maximum value.

The present invention is characterized in that the wedge-like passage is positively formed at the position of the seal portion 14 so as to prevent the undesirable mechanical contact by means of the pressure developed in the wedge-like oil film.

Accordingly, the present invention may be achieved in the range where the amount of eccentricity is according to the following condition.

$$0 < e_1 < e_2 \quad (4)$$

In the relation $e_1 \geqq e_2$, the load capacity $P_1$ is lowered, with an increase of the clearance $h_2$ at the central portion of the fluid passage B, and therefore, the average fluid resistance in said fluid passage is also reduced, thus resulting in undesirable increase of refrigerant leakage to an extent greater than that in the conventional arrangement of FIG. 3. On the other hand, the point where the load capacity reaches the maximum value in FIG. 8 is the same as the point where the dimensionless value n becomes 1.73, and if the amount of eccentricity $e_1$, clearance $h_2$ at the apex, and angle $2\psi_1$ subtending the arc of the seal circle of the seal portion 14 on the inner peripheral wall of the cylinder, are as in the following equation, the load capacity $P_1$ becomes the maximum.

$$e_1 = \frac{2h_2}{\psi_1^2} \cdot n^2 = \frac{5.99h_2}{\psi_1^2} \quad (5)$$

In other words, to maximize the load capacity the seal circle should have a radius $$Rs = r_1 + \frac{2h_2}{\psi^2} \cdot n^2$$

to form the arc shaped surface of the seal portion 14 on the cylinder 2 and subtended by the seal angle $2\psi$ and the center should be offset from the center of the rotor by $$\frac{2h_2}{\psi^2} \cdot n^2 - h_2.$$

It should be noted here that, in the foregoing embodiment, although the present invention has been mainly described with reference to a compressor having a cylinder with a round cross section, the concept of the present invention is not limited in its application to a cylinder having the round cross section, but may readily be applied to a cylinder having, for example, an elliptic cross section as well, in which case, the seal portion 14 may be provided at two positions.

In summary, in the compressor according to the present invention which includes the cylinder 2 having the cylindrical space for the vane chamber 8 therein, front and rear plates 5*a* and 5*b* secured to opposite end faces of the cylinder 2 for closing the vane chamber 8, the rotor 1 eccentrically rotatably mounted within the vane chamber 8, the plurality of vanes 3 each slidably received in the corresponding sliding grooves 4 in the rotor 1, and the rotary shaft 6 fixed to the rotor 1 for simultaneous rotation therewith and rotatably supported by the front and rear plates 5*a* and 5*b*, the seal portion 14 in the cylinder 2 at a position at which it which confronts the rotor head portion 10 where the peripheral surface of the rotor 1 is closest to the inner peripheral surface of said cylinder 2 for dividing the interior of the cylinder 2 into the fluid discharge side 11 and fluid suction side 12, is provided with a surface having arcuate shape lying on an imaginary seal circle 15 which has its center 03 between the center 01 of the rotor 1 and the center 02 of the cylinder 2, and the radius $r_2$ of which is represented by the relation $r_2=r_1+e_1+h_2$, and the distance $e_1$ between the centers 01 and 03 is according the relation $e_1 \simeq 5.99h_2/\psi^2$, where the angle subtending the seal portion 14 of the cylinder 2 is represented by $2\psi$, and the minimum clearance between the rotor 1 and cylinder 2 is denoted by $h_2$. Accordingly, as described earlier, the large dynamic pressure bearing effect due to the wedge-like oil film is produced between the rotor head 10 and the seal portion 14 of the cylinder 2 so as to prevent undesirable contact between the rotor and cylinder, and thus, the problems inherent in the conventional compressors of this kind as described earlier have been advantageously solved. In other words, by the arrangement of the present invention as described above, the clearance h at the rotor head portion 10 can be further reduced as compared with conventional arrangements, since there is no mechanical contact between the rotor and cylinder even when some side play or looseness are present at the bearings, etc., and the fluid passage ($B=r_1\psi$) can be elongated, and thus, the undesirable leakage of the refrigerant is decreased, with consequent improvement of the compression efficiency.

As is clear from the foregoing description, the present invention is widely applicable to volume type compressors in general of the type having a rotor, vanes, a cylinder and end plates as fundamental constituents, with remarkable effects being obtainable therefrom.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A rotary vane compressor comprising:

a rotor member;

a plurality of vanes slidably mounted in corresponding sliding grooves in said rotor member;

a hollow cylinder in which said rotor member and vanes are rotatably mounted at a position eccentric to the cross-sectional center of the hollow interior of said cylinder;

end plates secured to opposite ends of said cylinder for closing the hollow interior to define a vane chamber therein;

said rotor member having a rotor head portion where the peripheral surface of said rotor member approaches the inner peripheral surface of the hollow interior of said cylinder for dividing the interior of said hollow interior into a fluid discharge side and a fluid suction side;

said cylinder having a seal portion at the position opposed to said rotor head portion at which the inner surface of said hollow interior has a cross-sectional shape lying on the arc of a seal circle having a radius of curvature smaller than the radius of curvature of the cross-section of the inner surface of the hollow interior on circumferentially opposite sides of said seal portion, said seal portion having a cross-sectional seal circle center lying between the cross-sectional center of said rotor member and the cross-sectional center of said hollow interior, and at a distance $e_1$ from said cross-sectional center of said rotor and having a radius $r_2=r_1+e_1+h_2$, where $r_1$ is the radius of said rotor member and $h_2$ is the minimum clearance at the seal portion, and $e_1$ has a value $0<e_1<e_2$, where $e_2$ is the distance between said cross-sectional centers of said hollow interior and said rotor member.

2. A compressor as claimed in claim 1 in which said distance $e_1$ has a value $$e_1 \simeq \frac{5.99h_2}{\psi 1^2}$$

where $2\psi$ is the angle at the cross-sectional center of said rotor member subtending the arc of said seal portion.

* * * * *